US012766363B2

(12) United States Patent
York et al.

(10) Patent No.: US 12,766,363 B2
(45) Date of Patent: Oct. 20, 2026

(54) INTENDED ZONE TRACKER

(71) Applicant: Driveline Baseball Enterprises LLC, Kent, WA (US)

(72) Inventors: Garrett D. York, New Castle, IN (US); Jorge Diaz, Lacey, WA (US); Chris Langin, Scottsdale, AZ (US)

(73) Assignee: Driveline Baseball Enterprises LLC

( * ) Notice: Subject to any disclaimer, the term of this patent is extended or adjusted under 35 U.S.C. 154(b) by 183 days.

(21) Appl. No.: 18/680,200

(22) Filed: May 31, 2024

(65) Prior Publication Data

US 2025/0242201 A1 Jul. 31, 2025

Related U.S. Application Data

(60) Provisional application No. 63/626,004, filed on Jan. 28, 2024.

(51) Int. Cl.

| | |
|---|---|
| ***A63B 24/00*** | (2006.01) |
| ***A63B 71/06*** | (2006.01) |
| *A63B 102/18* | (2015.01) |

(52) U.S. Cl.

CPC ..... *A63B 24/0021* (2013.01); *A63B 71/0622* (2013.01); *A63B 2024/0034* (2013.01); *A63B 2102/18* (2015.10); *A63B 2102/182* (2015.10); *A63B 2220/807* (2013.01); *A63B 2220/89* (2013.01)

(58) Field of Classification Search

CPC ..... A63B 24/0021; A63B 71/0622; A63B 2102/18; A63B 2102/182; A63B 2024/0034; A63B 2220/807; A63B 2220/89

USPC ..... 700/91

See application file for complete search history.

(56) References Cited

U.S. PATENT DOCUMENTS

| | | | | |
|---|---|---|---|---|
| 2010/0041498 | A1* | 2/2010 | Adams | A63B 24/0006 473/451 |
| 2021/0093941 | A1* | 4/2021 | Teeger | G01B 11/02 |
| 2022/0035000 | A1* | 2/2022 | Søndergaard | G01S 7/4008 |

* cited by examiner

*Primary Examiner* — Robert P Bullington

(74) *Attorney, Agent, or Firm* — AEON Law, PLLC; Adam L. K. Philipp; Charlotte E. Holoubek

(57) ABSTRACT

Systems and methods for tracking pitched ball trajectories, analyzing detailed data, and providing interactive feedback to improve hitting intended strike zones and pitching effectiveness. Customizable tracking hardware captures 3D trajectory data. Algorithms generate trajectory models and metrics versus configured strike zone targets. Visualizations, diagnostics, and training prescriptions provided based on modeled trajectories and database-driven insights.

22 Claims, 8 Drawing Sheets

INTENDED ZONE TRACKER

CROSS REFERENCE

The present application claims priority to U.S. Provisional Application No. 63/626,004, filed Jan. 29, 2024, "Intended Zone Tracker," which is hereby incorporated by reference.

TECHNICAL FIELD

The present disclosure relates to a technological system for improving a baseball or softball pitcher's ability to consistently locate pitches within an intended zone.

BACKGROUND

Motion tracking and biomechanical analysis technologies have applications across sports training, physical therapy, industrial workflows, and other domains involving analyzing and improving repetitive human or object motions. There is a need for techniques and systems that can accurately and reliably capture detailed motion data, process it to extract biomechanical parameters, and provide actionable and personalized feedback for correcting deficiencies and improving performance.

In the field of baseball pitching, the concept of the "kinetic chain" has been established, referring to the sequence of energy transfer through the body during the pitching motion. As explained by Kyle Boddy in the book Hacking the Kinetic Chain, proper timing and sequencing in the kinetic chain is crucial for injury prevention and performance optimization in pitching. However, deficiencies such as "opening up" too early are common and disrupt the kinetic chain. Quantitative analysis of video, sensor data, and metrics like timing of pelvis rotation can identify kinetic chain problems. Prescriptive training programs (e.g., using weighted implements, bands, and other tools) can help ingrain proper mechanics and strengthen the kinetic chain. Data-driven biomechanical analysis combined with sport-specific training can enhance both health and performance outcomes.

The principles discussed above have enabled athletes to achieve significant gains in areas such as conditioning and pitch velocity. However, in baseball and softball pitching, it is important for pitches to pass through specific zones of the strike zone to be effective. However, it can be challenging for pitchers to consistently locate their pitches in the intended zone. Conventional pitch tracking systems rely on radar guns or plate-based cameras to track general pitch metrics like velocity, spin rate, and basic location (e.g., strike vs. ball). Although they can measure the ball's actual flight path, they do not assess the pitcher's intended target or location. Moreover, they lack detailed analysis of the ball's path through the plate area and in relation to the pitcher's intended zone. There is a need for improved technology to measure or determine the athlete's intended pitch location, and then either manually or with technology determine the actual pitch location. The present disclosure describes embodiments of such a system.

SUMMARY

In one embodiment, a system for tracking intended zone, the Intended Zone Tracker, includes, or is operable with external, motion capture devices and an interactive user interface configured to provide prescriptive feedback. The system employs machine learning techniques to improve biomechanics computation and feedback personalization. Cloud architecture provides access across client devices.

More specifically, the Intended Zone Tracker is a system for tracking and analyzing the trajectory of the pitch relative to the intended zone. The system includes:

A portable, lightweight tracking unit with integrated sensors and processing capabilities to track the ball's location in 3D space throughout its trajectory. (This could be the Trackman device referenced below or similar technologies that may be available.)

Tracking algorithms that process the sensor data to generate a detailed trajectory model of each pitch identifying boundaries, breaks, and other characteristics. (Once again, this could be implemented with the Trackman or similar technology.)

Strike zone configuration based on standard dimensions or custom batter profiles that define target zones.

Analysis software that matches tracked trajectories to the configured strike zone to determine aim points, release points, projected path, and zone entry locations. The software matches intended zone metric to the normal data collected. The inventive system can generate miss distance and other metrics through the collection of intended zones.

Metrics quantifying key factors like location consistency, breaks relative to aim direction, and timing of entry into intended zone(s).

Integration with a device (e.g., Trackman B1 portable unit) to capture advanced metrics. The inventive system is unique as it may integrate with Trackman or other tracking technologies combined with the data gained from leveraging intended zones data. The invention provides significant improvements in training/strategy that come from incorporating the intended zones data into an athlete's training.

Generated reports that display pitch trajectories overlaid on the strike zone with key metrics for coaches and players to understand causes of location inconsistencies and improve command of intended zones.

Web/mobile app for data visualization, advanced analysis, metric sharing, and personalized training prescriptions based on pitch data.

The system provides insight into the detailed trajectory, release point, breaks, and other characteristics that determine the location a pitch crosses the plate. The diagnostic metrics and tools provided enable personalized training to improve consistency, accuracy, and effectiveness of locating pitches in the intended zone. With the present invention, the pitcher declares his/her intention, which makes the analysis and feedback more effective and distinguishes the system from what others have done.

In summary, we describe a system that tracks and analyzes pitching trajectories using a tracking unit with sensors to capture ball location data. The sensor data is processed to generate detailed 3D trajectory models. The system includes configurable strike zone and target zone dimensions. Analysis algorithms match the tracked trajectories to the zones to determine metrics like aim points, release points, projected paths, entry locations, and timing. Integration with commercially available tracking devices provide advanced metrics. Visualizations overlay trajectories on the zones along with the metrics. The system enables personalized feedback and training prescriptions to improve pitch location consistency and effectiveness. The intended pitch location declaration by the pitcher is a key distinguishing aspect.

DETAILED DESCRIPTION OF ILLUSTRATIVE EMBODIMENT

Overview

Figure 1:
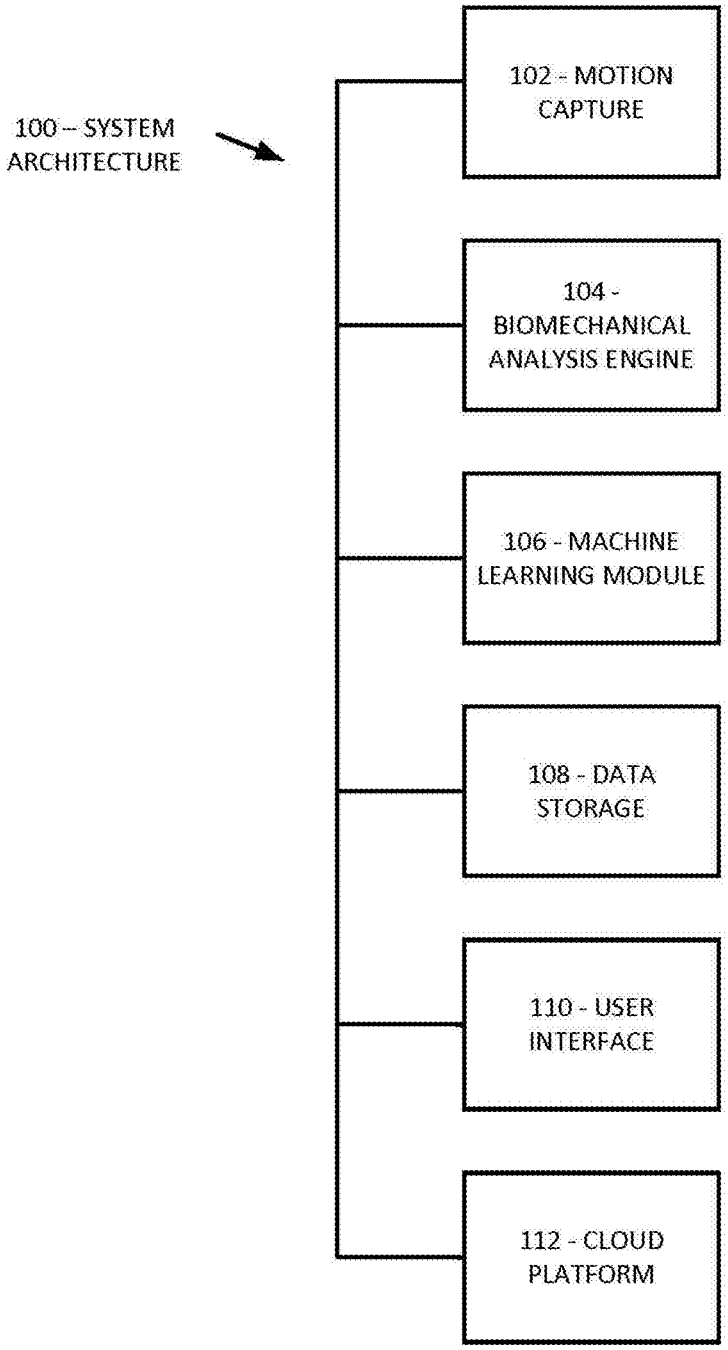
FIG. 1 shows an example system architecture according to one embodiment.

The Intended Zone Tracker system comprises hardware and software technology to capture detailed data on pitched ball trajectories and analyze the data to provide feedback on hitting intended strike zones.

The hardware includes one or more sensors integrated into a portable, lightweight tracking unit that can track the position of the ball in three-dimensional space throughout its trajectory from release by the pitcher to crossing the plate. The tracking unit employs technologies such as radar, LIDAR, high-speed cameras, computer vision software, and IMUs to accurately capture xyz position data of the ball at high frequency through the entire trajectory. In one embodiment, the tracking unit is portable and can be operated from behind home plate to non-intrusively capture pitch data during games, practices, training sessions, etc. The tracking unit embodiment with integrated sensors and on-board processing capabilities provides ease of setup and use. The captured sensor data is processed using algorithms to generate a detailed trajectory model for each pitch. Additionally, other embodiments could take the form of a device configured to be located between the pitcher and home plate or behind the pitcher.

The software includes configuration capabilities to define the dimensions of the strike zone based on league standards or custom batter profiles. Target zones are identified within or relative to the defined strike zone, such as inside/outside corners or upper/lower thirds. (It should be noted that the system can locate outside the strike zone as well as inside the strike zone. Locating outside the strike zone is commonly done in advantage counts where swing decisions are more likely to extend out of the strike zone.) The tracked pitch trajectory models are analyzed relative to the configured strike zone and intended zones using proprietary algorithms. Key analysis results provided by the software include:

- Release point of each pitch
- Aim point/direction of the pitch based on initial trajectory.
- Projected trajectory path absent breaks
- Location, angle, and timing of breaks in the trajectory relative to aim direction.
- Consistency metrics quantifying variability of aim point, release point, and zone entry location.
- Entry point, location, and timing of pitch entering intended zone(s)

Additional capabilities and integrations further enhance insights into pitch trajectories:

- Integration with a portable tracking unit (e.g., Trackman) using embedded inertial sensors, provides Pitcher Command metrics quantifying consistency hitting locations, speed adjustments, and more.

Customizable machine learning algorithms trained on pitch metric databases can detect differences from idealized models for personalized feedback.

Aggregated databases of pitches thrown with the system provide valuable data sets for training and improving ML algorithms as well as developing insights into pitching mechanics and effectiveness.

The system outputs useful visualizations including the 3D trajectory model of each pitch overlaid on the configured strike zone and intended zones. The key metrics are displayed in conjunction with the trajectory visualization to assist understanding of why certain pitches missed or hit the intended zone and guide training adjustments.

The system includes web and mobile applications providing additional features including advanced analytics, sharing metrics with coaches/teammates, generating reports, and prescribing personalized training programs based on identified pitching deficiencies and requirements.

In summary, the Intended Zone Tracker employs a unique combination of tracking hardware, trajectory analysis algorithms, strike zone configuration, metric generation, visualization capabilities, and personalization features to provide unprecedented insight into pitching mechanics and detailed diagnostics on hitting intended locations. The system aims to significantly improve consistency, accuracy, and effectiveness for pitchers.

System Architecture

FIG. 1 shows an example system architecture according to one embodiment. System architecture 100 comprises a motion capture device 102, a biomechanical analysis engine 104, a machine learning module 106, a data storage module 108, a user interface 110, and a cloud platform 112.

The system is designed such that the Intended Zone Tracker does not need to include biomechanical analysis but could be paired with biomechanic analysis data. For example, the motion capture device 102 is a hardware component that tracks motion data of a user. It contains sensors such as cameras, depth sensors, and inertial measurement units to capture positional, rotational, velocity and acceleration data in three dimensions as the user performs motions. The motion capture device 102 outputs raw motion data to the biomechanical analysis engine 104.

Biomechanical analysis engine 104 is a software component that processes the raw motion data to generate biomechanical parameters. It contains programming logic to transform the data into a skeletal model of the user and extract biomechanical factors related to posture, joint angles, force, torque and other variables relevant to assessing the mechanics of the motion. The biomechanical analysis engine 104 outputs these biomechanical parameters to the machine learning module 106.

Although the system is not a biomechanical analysis tool in the sense that it is tracking the human movements, the machine learning module 106 employs artificial intelligence algorithms trained on data, which may include biomechanical data if available, to generate personalized models and assessments. It contains programming logic for statistical learning techniques including neural networks, regression, and clustering. Machine learning module 106 can output a personalized model of optimal biomechanics for the user. It can also output an assessment of deficiencies in the user's biomechanics compared to the model. These outputs are provided to user interface 110.

The data storage module 108 provides persistent storage of motion data, biomechanical parameters, user models, and other system data. It is implemented with database technologies like SQL, NoSQL, and blob storage. The data storage module 108 interfaces with all system components to store their inputs and outputs.

The user interface 110 is a software component that provides interaction with users of the system. It contains graphical displays, visualizations, and controls to configure sessions, view data, and receive assessments. The personalized models and biomechanical assessments from the machine learning module 106 are provided to users via interface 110.

Cloud platform 112 provides computing infrastructure to host the system architecture and serve users over the network. It employs cloud technologies like containers, load balancing, and auto-scaling to deliver the system as a cloud service. User interface 110 can be accessed by clients through cloud platform 112.

Machine Learning Pipeline

Figure 2:
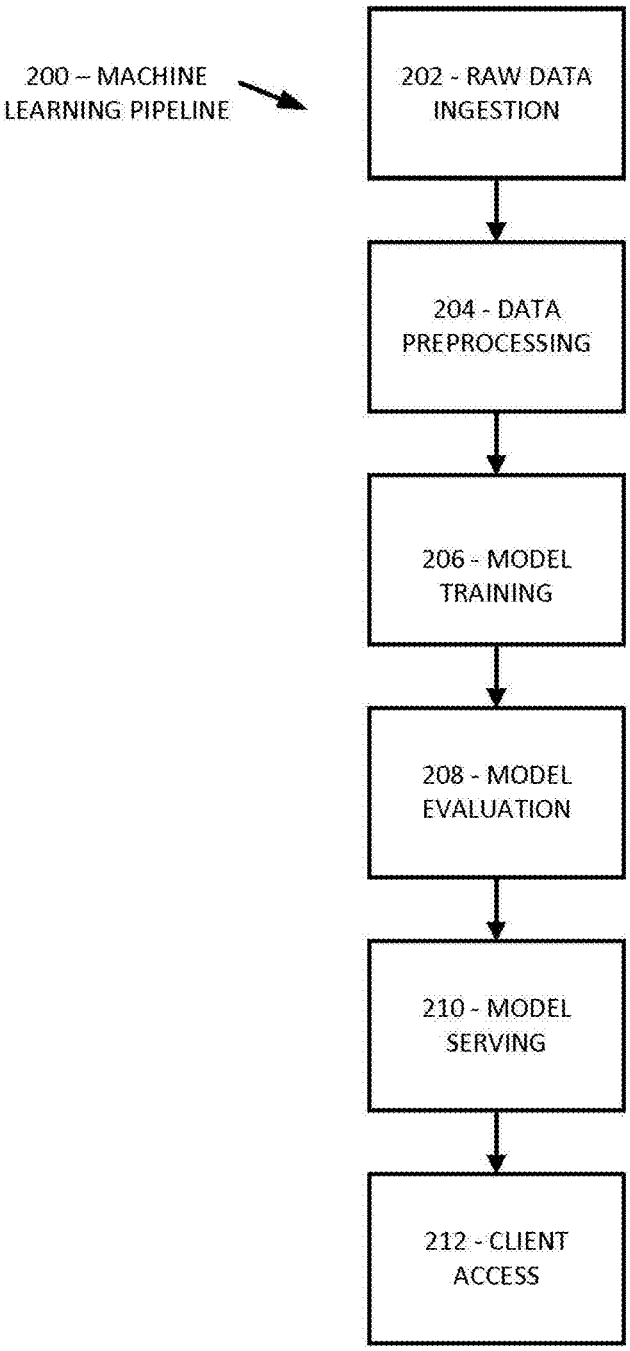
FIG. 2 illustrates an example machine learning pipeline for generating personalized feedback according to one embodiment.

FIG. 2 illustrates an example machine learning pipeline 200 for generating personalized feedback according to one embodiment. The pipeline comprises raw data ingestion 202, data preprocessing 204, model training 206, model evaluation 208, model serving 210, and client access 212 stages.

The raw data ingestion 202 stage gathers motion data from user sessions and uploads it to the system's data storage. The motion data can come from the motion capture device and biomechanical analysis components. The data is accumulated into a large training dataset.

The data preprocessing 204 stage cleans and prepares the uploaded raw data for machine learning. It can filter outliers, normalize values, select subsets of data, and engineer new features. This preprocessed data is used to train models.

The model training 206 stage takes the preprocessed data and trains machine learning models on it. Different types of models like neural networks and regression can be trained using various supervised or unsupervised learning techniques. The algorithms learn from examples to make predictions.

The model evaluation 208 stage tests the trained models on validation datasets to measure their accuracy and reliability. Models not reaching performance targets are retrained or replaced until assessment criteria are met.

The model serving stage 210 deploys the validated models to make them available for generating user-specific assessments. The models are hosted to low-latency, scalable prediction servers.

The client access 212 stage provides user interfaces that leverage the deployed models. Users can obtain biomechanical assessments and personalized motion recommendations via apps and web platforms. Their new session data can also be fed back into the pipeline.

For generating personalized biomechanical models, supervised learning techniques like regression algorithms and neural networks are used. Regression algorithms such as linear regression, LASSO, and ridge regression can model the relationships between biomechanical parameters and performance metrics based on training examples. Neural networks with multiple hidden layers can learn complex nonlinear relationships in the data to predict optimal individual biomechanics.

For generating personalized deficiency assessments, algorithms like k-nearest neighbors, random forests, and support vector machines are used. These algorithms classify biomechanical data points into categories like "good" or "bad" based on similarity to examples in the training data. This allows assessment of a user's biomechanics against models of proper technique.

Unsupervised learning approaches like k-means clustering are also used to find natural groupings in the biomechanical data to identify patterns and anomalies. This allows discovery of new insights without predefined categories.

Cross-validation techniques are employed to measure model accuracy against test datasets and avoid overfitting. Regularization methods like dropout and early stopping prevent overspecialization of the training data.

The algorithms are optimized to leverage available data while adapting to individual variances. With more user data collected over time, the machine learning module can refine the models and assessments for increasingly personalized feedback. Advanced techniques like transfer learning and federated learning allow collaborative learning over distributed data while preserving privacy.

The module combines proven machine learning techniques with the domain expertise required for biomechanical modeling and assessment in an innovative approach to generate accurate and tailored insights from motion data.

Cloud Implementation

Figure 3:
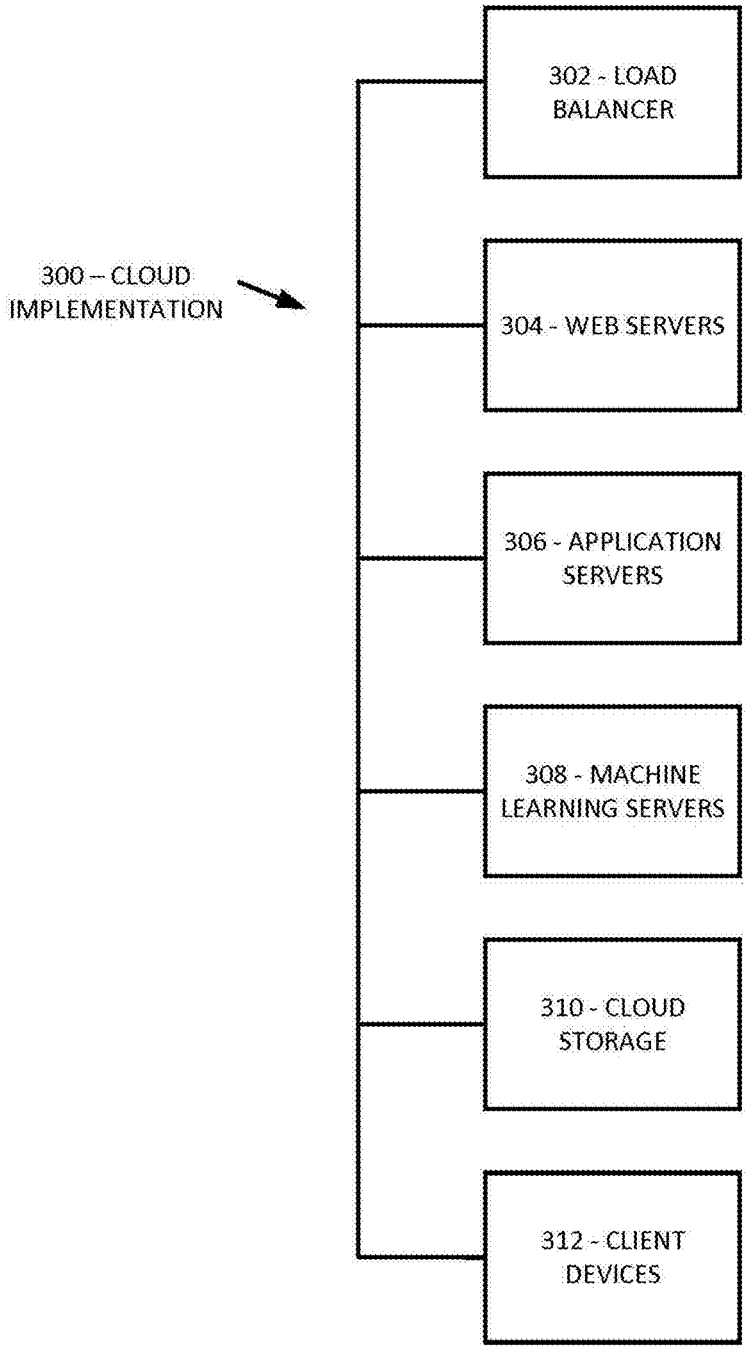
FIG. 3 shows an example cloud implementation and example client devices according to one embodiment.

FIG. 3 shows an example cloud implementation and client devices according to one embodiment. The cloud implementation 300 comprises a load balancer 302, web servers 304, application servers 306, machine learning servers 308, and cloud storage 310.

The load balancer 302 distributes requests across multiple servers to handle variable user loads. It implements load balancing algorithms to optimize resource utilization.

The web servers 304 handle client communications and serve web interfaces. They process HTTP(S) requests, serve web pages, and stream data to clients. The web servers 304 communicate with the application servers 306.

The application servers 306 host the core system logic and components like the biomechanical analysis and machine learning modules. They perform intensive processing of motion data and models. The application servers 306 fetch and store data in cloud storage 310.

The machine learning servers 308 are specialized servers optimized to run machine learning workloads like model training and prediction. They can have GPU acceleration and other ML-specific optimizations. The model pipelines run on these servers.

Cloud storage 310 provides scalable data storage capacity for the system's database needs. It can leverage database systems like SQL, NoSQL, blob stores, and data warehouses.

Client devices 312 access the cloud implementation 300 over the network. The client devices can include tablets, computers, smartphones, virtual reality headsets, wearables, and other devices with web or app interfaces.

Intended Zone Tracker Construction and Use

Figure 4A:
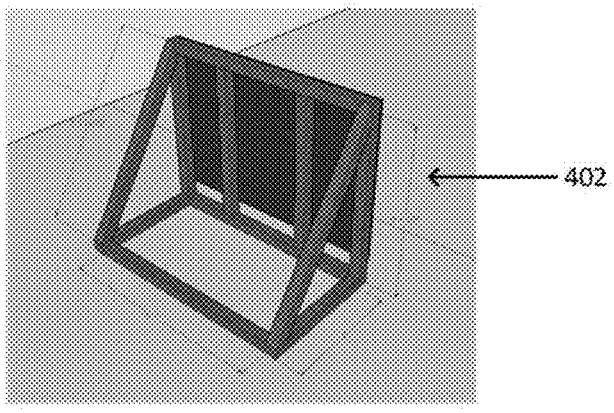
FIGS. 4A-4F depict exemplary devices that may be employed to implement the Intended Zone Tracker in a baseball or softball setting.
Figure 4B:
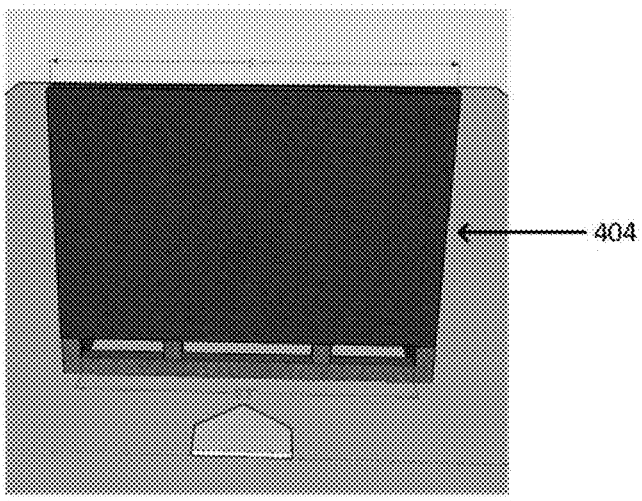
Figure 4C:
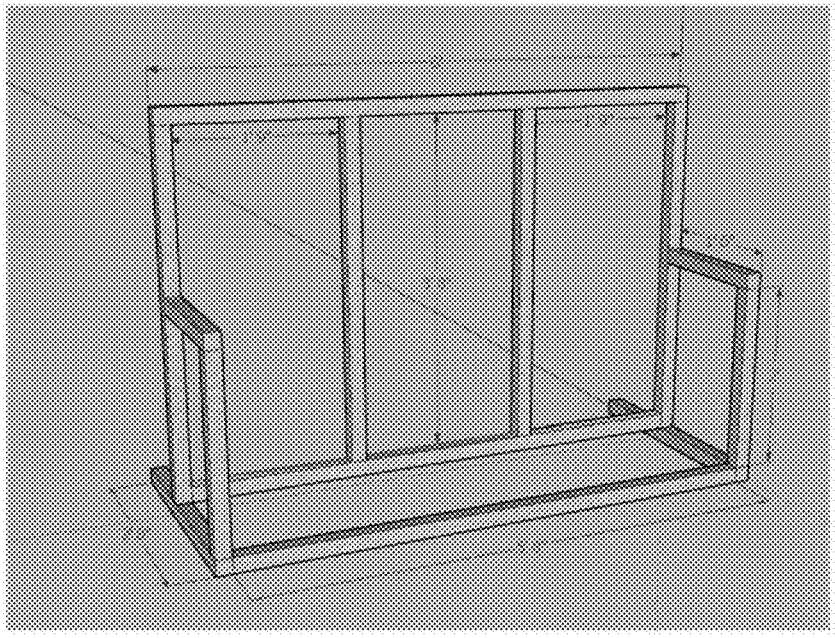
Figure 4D:
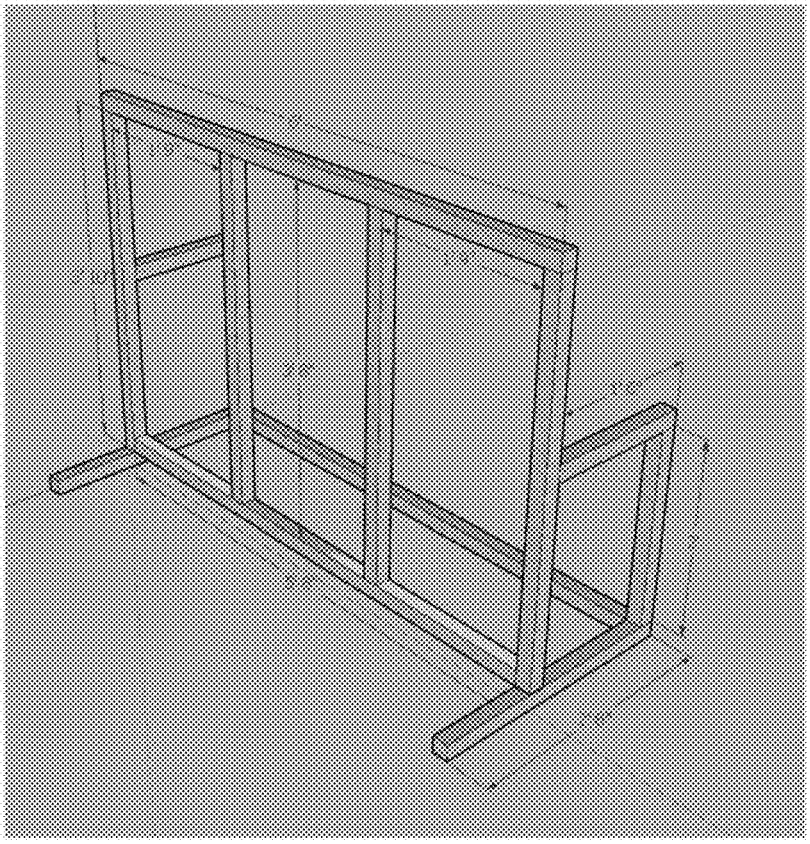
Figure 4E:
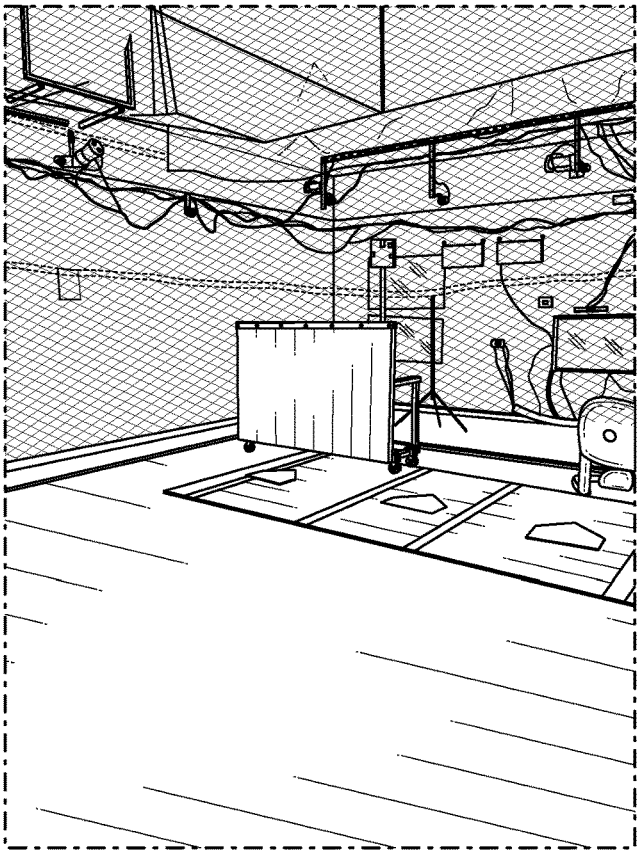
Figure 4F:
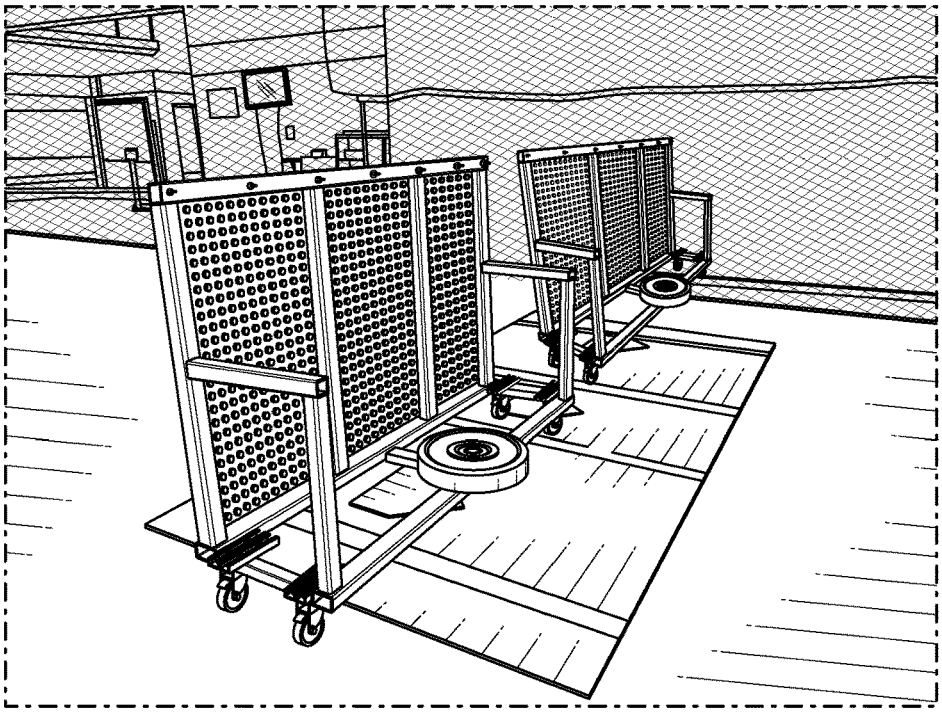
Figure 5A:
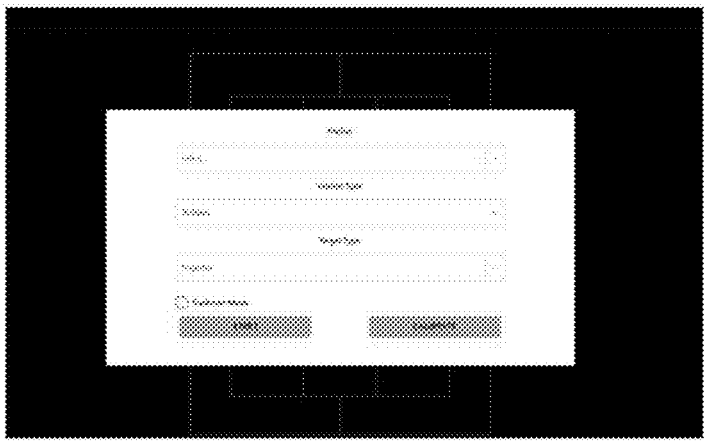
FIGS. 5A-5D depict screen displays related to pitch visualizations, metrics, etc., as described below.
Figure 5B:
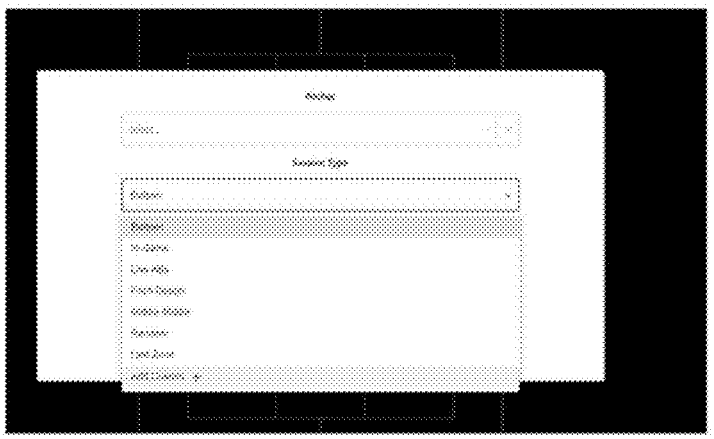
Figure 5C:
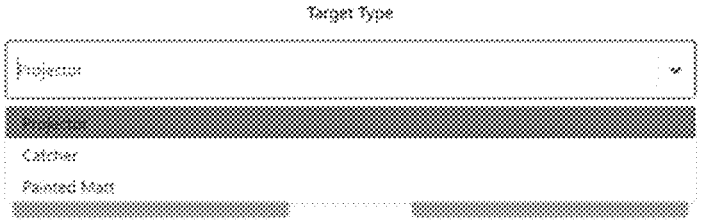
Figure 5D:
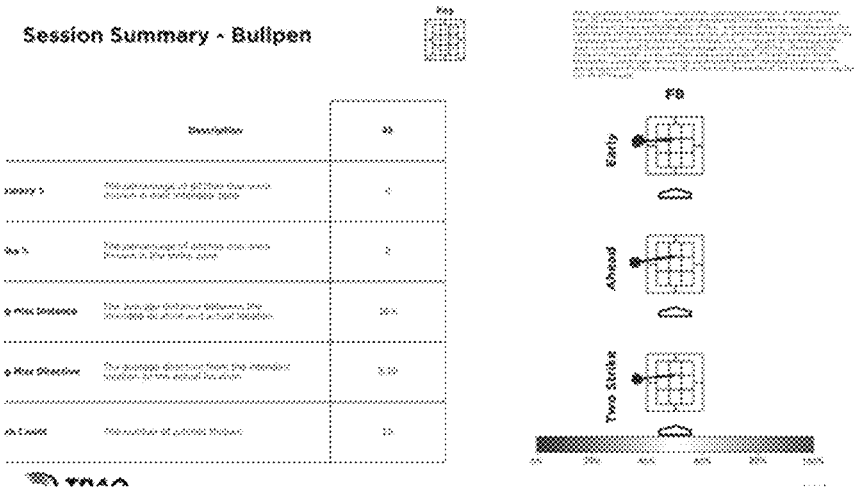

One example of additional devices employed to implement the Intended Zone Tracker includes a projector target, which in this example includes a 2 in square tube steel frame, as shown in FIG. 4A, and a 4×6 foot ¾ in horse stall mat, as shown in FIG. 4B. FIGS. 4C-4F depict later implementations. A projector, not shown, may be used to project the zone map onto the mat.

Referring now to FIGS. 5A-5D, we will now describe the operation of the Intended Zone Tracker from the user's perspective:

The user positions the projector and the projector target appropriately and connects HDMI and power cable to the projector. HDMI runs to the computer at the pitching station/lane. A Bluetooth connection may alternatively be used for data transfer.

Open the webapp and run the calibration to ensure the strike zone projected matches the strike zone dimensions of the tracking unit (for example, the dimensions of the Trackman portable tracking unit). The strike zone dimensions are measured and drawn onto the physical target to aid in the calibration. Two dots are painted on the mat for use in aligning and calibrating the tool with mouse clicks.

Start a tracking unit session, e.g., with the Trackman mobile app.

From the webapp UI, the user will be able to select the newly started session.

The Pitcher selected pulls from the TRAQ database (TRAQ is custom developed athlete management software).

Pending the session type, the user will select various settings throughout the session including intended location, pitch type, ball weight, the count (i.e., 3 balls 2 strikes, 3-2).

Each time a pitch is thrown, the tracking unit sends pitch data to webhooks provided in the platform. The pitch data upon being received is parsed, processed, and logged to our database. In the example videos below the data may be manipulated via our code or models to produce new insights.

There is a secondary feedback panel (secondary webapp) the users can open on a separate monitor that can be used to view live advanced metrics as the session progresses. Upon session end, the user can export the data to their profile. Additionally, the platform may provide a custom report API to provide direct insights to the user about their past session.

The following paragraphs provide further information concerning functional components of an early implementation of the software outlined above.

Webapp UI

Main Function—provide an intuitive interface for athletes to engage with the IZTP for configuration, data collection, and initiation of analytical reports or data logging.

Operation of Function—using JavaScript functionality along with various APIs written in Python, PHP, and R to read and write data or trigger report generation.

Result Achieved—IZTP can be configured and operated by a non-technical audience to improve a pitcher's performance.

Webhooks

Main Function—ingest raw data in JSON format from Trackman and stores for record-keeping, analysis, and further processing.

Operation of Function—The webhook operates by listening for HTTP POST requests sent to its URL endpoint. Once a request is received, it extracts the relevant data from the request payload. The data is then formatted and validated according to predefined schemas to ensure consistency and accuracy. Following this, the processed data is inserted into specific tables in the MySQL database using SQL queries.

Result Achieved—real time data collection and storage.

Feedback Panel

Main Function—Provide the athlete and trainer with live insights about their current performance with advanced metrics.

Operation of Function—The feedback panel is a separate interface (seen in videos mentioned in link above) that receives data via WebSocket. It performs live calculations and provides real-time metrics.

Results Achieved—Provides live feedback and metrics to the athlete and trainer without compromising the intended zone data collection process. The use of the panel gives the opportunity to make in-session adjustments and other changes to provoke higher performance from the athlete.

Trackman B1 Unit

Main Function—The primary function of the Trackman B1 Unit (or functionally equivalent technology) is to accurately measure and analyze the dynamics of baseball pitches. This includes tracking pitch speed, spin rate, trajectory, and other relevant metrics that are crucial for both player performance analysis and coaching strategies.

Operation of Function—The unit operates using a combination of radar technology and sophisticated algorithms. When a baseball is pitched, the radar system within the Trackman B1 Unit emits radio waves that bounce off the moving ball. The reflected waves are then captured by the unit's sensors. The time difference and the change in frequency of these waves (due to the Doppler effect) are analyzed by the onboard algorithms to calculate various metrics like speed, spin, and trajectory of the pitch. This data is processed in real-time, providing immediate feedback.

Results achieved—By using the Trackman B1 Unit, coaches and players gain a detailed understanding of pitching performance. The device provides valuable data that can be used to improve a pitcher's technique, adjust training programs, and develop strategies for games. The real-time analysis allows for immediate adjustments and feedback, making training sessions more efficient and targeted. Furthermore, the data collected can be used for long-term tracking of a player's progress and for scouting purposes.

Personalized Training Prescriptions

The Intended Zone Tracker software includes advanced analysis features to generate personalized training prescriptions for pitchers based on their tracked pitch data.

The prescriptions are generated by analyzing the pitcher's metrics and trajectory models relative to idealized models and identifying deficiencies. The personalized prescriptions target the specific deficiencies detected in the pitcher's mechanics.

Some examples of how training prescriptions are generated:

If release point consistency is low, prescriptions may include drills for repeating delivery mechanics and release.

If aim direction or projection path deviates consistently from the intended zone, prescriptions may include visual training aids to ingrain proper throwing mechanics.

If breaks are inconsistent, weighted or restrictive implements may be prescribed to amplify feel for proper throwing motion and release.

If timing of zone entry is late due to slow velocity, strength training or movement pattern drills may be prescribed.

The software accesses libraries of training drills, programs, and tools mapped to common pitching deficiencies. Machine learning algorithms match tracked data to idealized models to identify deficiencies for each pitcher. Prescriptions are selected from the libraries based on likely effectiveness for targeting the detected issues.

Coaches can configure prescription settings like recommended workload, schedule, and focus areas. Advanced versions may adjust the prescriptions dynamically based on measured progress.

By leveraging biomechanical analysis algorithms, large pitch data sets, machine learning, and customizable libraries of training content, the system automates delivery of targeted, personalized prescriptions to efficiently improve command, consistency, and effectiveness for pitchers.

Alternative Embodiments

The Intended Zone Tracker system can be implemented with variations in hardware, software, and applications within the scope of the invention. Some viable alternative embodiments are described below.

Instead of a web application, a mobile application on platforms like iOS could be used for system configuration, operation, and displaying feedback. Visualizations and metrics could be adapted to the mobile experience. This provides accessibility and portability.

Instead of simply projecting a standard strike zone, the system could project heat maps of real or simulated hitter tendencies. For example, zone profiles could be generated from a hitter's session history or swing metrics to create personalized scenarios. Facing an upcoming team's lineup based on scouting reports allows pitchers to practice against realistic situations. The difficulty could be artificially increased to add game pressure.

Instead of simulated at-bats having fully stochastic outcomes, results could be biased by available data on hitter or pitcher matchups. Publicly available stats or previously collected session data could make the simulations more realistic.

The tracking technology could be adapted to work with alternatives to Trackman that provide similar high-frequency 3D trajectory data. The system does not depend on a specific tracking hardware embodiment.

The system could extend beyond baseball to other throwing sports like softball, cricket, football, etc. The machine learning models would be retrained on relevant biomechanical parameters, but the overall approach is applicable.

Various proprietary or third-party AI/ML models developed by Driveline could be incorporated to enhance simulation, analysis, recommendations, and other capabilities. Example models include predicting pitch types, simulating at-bats against specific hitters, recommending training regimens, and more.

These alternative implementations demonstrate the flexibility of the Intended Zone Tracker system to employ different technologies, configurations, integrations, and applications without deviating from the core inventions. The scope is intended to encompass these and other variations.

CONCLUSION

The Intended Zone Tracker provides a technological system for significantly improving a pitcher's ability to consistently locate pitches to the desired location. The system achieves this through several key innovations:

Streamlined collection and pairing of intended pitch location data with detailed 3D trajectory tracking data and additional biomechanical metrics. This enables direct correlation of intent versus outcome.

Interactive experience with real-time advanced metrics and personalized feedback for pitchers based on their data. This allows adjustments during training sessions.

Custom strike zone configuration and trajectory overlay visualizations that illustrate the relationship between pitches and intended zones.

In-depth trajectory analysis algorithms that quantify release point, aim, breaks, entry timing, and consistency.

Integration of proprietary tracking devices and biomechanics analysis programming for unparalleled pitch data.

Machine learning techniques that generate personalized models and prescriptions tailored to each pitcher's needs.

Cloud-based access that allows use across various devices and sharing with coaches/teammates.

The system provides pitchers with an unprecedented combination of insights, diagnostics, metrics, and tools to understand their pitching and refine their mechanics for hitting intended locations. This achieves the primary technical purpose of significantly improving command, accuracy, and effectiveness.

The described embodiments and features should not be considered limiting. The disclosed inventions may be implemented through many variations in device technologies, system architectures, machine learning techniques, computing environments, and user interaction modes.

Wherefor we claim:

1. A system for tracking and analyzing a trajectory of a pitch relative to an intended zone, the system comprising:

a tracking unit (102) comprising one or more sensors configured to track a location of a ball in a three-dimensional space throughout a trajectory of the ball; and a computing device (104) operatively coupled to the tracking unit and comprising a processor and a memory, the memory storing instructions that, when executed by the processor, cause the processor to:

generate a trajectory model of the pitch based on sensor data from the tracking unit;

receive an input from a user indicating an intended zone for the pitch, the intended zone being selected or declared by the pitcher for that specific pitch prior to release;

analyze the trajectory model to determine a plurality of metrics of the pitch relative to the intended zone, the plurality of metrics comprising a location of the pitch in the intended zone, a miss distance to the intended zone, and a timing of entry of the pitch into the intended zone; and generate a feedback report indicating the plurality of metrics.

2. The system of claim 1, wherein the feedback report comprises a visualization of the trajectory model of the pitch overlaid on a representation of the intended zone.

3. The system of claim 1, wherein the computing device is a portable computing device.

4. The system of claim 1, further comprising a projector configured to project a zone map onto a target.

5. The system of claim 4, further comprising a camera configured to capture an image of the target, wherein the computing device is further configured to calibrate the intended zone based on the image of the target to ensure the strike zone projected matches the strike zone dimensions of the tracking unit, wherein the strike zone dimensions are measured and drawn onto the physical target to aid in the calibration, and wherein two dots are painted on the mat for use in aligning and calibrating the tool with mouse clicks.

6. The system of claim 1, wherein the tracking unit comprises a radar unit.

7. The system of claim 1, wherein the plurality of metrics further comprises at least one of a release point, an aim point, a projected trajectory path, a location of a break, an angle of a break, a timing of a break, a consistency metric, or an entry location.

8. The system of claim 1, wherein the computing device is further configured to determine the intended zone based on a user profile.

9. The system of claim 1, wherein the computing device is further configured to determine the intended zone based on a pitch type input received from the user.

10. The system of claim 1, wherein the computing device is further configured to aggregate the sensor data from the tracking unit with data from a plurality of additional tracking units to generate a pitch database.

11. The system of claim 1, further comprising an output device configured to provide the feedback report to the user.

12. A method for tracking and analyzing a trajectory of a pitch relative to an intended zone, the method comprising:

tracking, by a tracking unit comprising one or more sensors, a location of a ball in a three-dimensional space throughout a trajectory of the ball;

generating, by a computing device, a trajectory model of the pitch based on sensor data from the tracking unit;

receiving, by the computing device, an input from a user indicating an intended zone for the pitch, the intended zone being selected or declared by the pitcher for that specific pitch prior to release;

analyzing, by the computing device, the trajectory model to determine a plurality of metrics of the pitch relative to the intended zone, the plurality of metrics comprising a location of the pitch in the intended zone, a miss distance to the intended zone, and a timing of entry of the pitch into the intended zone;

generating, by the computing device, a feedback report indicating the plurality of metrics; and providing the feedback report to the user.

13. The method of claim 12, wherein the feedback report comprises a visualization of the trajectory model of the pitch overlaid on a representation of the intended zone.

14. The method of claim 12, wherein the computing device is a portable computing device.

15. The method of claim 12, further comprising projecting the intended zone onto a target.

16. The method of claim 15, further comprising capturing an image of the target; and calibrating the intended zone based on the image of the target.

17. The method of claim 12, wherein the tracking unit comprises a radar unit.

18. The method of claim 12, wherein the plurality of metrics further comprises at least one of a release point, an aim point, a projected trajectory path, a location of a break, an angle of a break, a timing of a break, a consistency metric, or an entry location.

19. The method of claim 12, further comprising determining the intended zone based on a user profile.

20. The method of claim 12, further comprising determining the intended zone based on a pitch type input received from the user.

21. The method of claim 12, further comprising aggregating, by the computing device, the sensor data from the tracking unit with data from a plurality of additional tracking units to generate a pitch database.

22. A system for tracking and analyzing the trajectory of a pitch relative to an intended zone, the system comprising:

a tracking unit comprising one or more sensors and a processor configured to capture sensor data of the pitch and determine a three-dimensional trajectory of the pitch;

a user interface configured to receive input specifying dimensions of a strike zone and one or more target zones within the strike zone, and to receive, for a specific pitch prior to release, a user-declared intended zone for the pitch, and to display a visualization of the pitch trajectory;

a database storing the specified strike zone and target zone dimensions; and an analysis module configured to:

retrieve the pitch trajectory from the tracking unit and the specified strike zone and target zone dimensions from the database;

determine, based on the pitch trajectory, an aim point, a release point, a projected path, and a zone entry location of the pitch relative to the specified strike zone and target zones;

calculate a plurality of metrics based on the determined aim point, release point, projected path, and zone entry location, the metrics comprising at least consistency of pitch location relative to the target zones and timing of entry of the pitch into the target zones;

generate an overlay visualization including the pitch trajectory, the strike zone, the one or more target zones, and an indication of the user-declared intended zone with a miss vector and timing annotation; and output the generated visualization to the user interface.

* * * * *